United States Patent [19]

Cushman et al.

[11] Patent Number: 4,490,069

[45] Date of Patent: Dec. 25, 1984

[54] PORTABLE HIGHWAY WARNING APPARATUS

[76] Inventors: Robert P. Cushman, 4601 Curtiss Dr., Virginia Beach, Va. 23455; Robert P. Cushman, Jr., Rte. 1, Box 484, Eveleth, Minn. 55734

[21] Appl. No.: 354,439

[22] Filed: Mar. 3, 1982

[51] Int. Cl.[3] ..... E01F 9/00

[52] U.S. Cl. ..... 404/15; 404/36

[58] Field of Search ..... 404/15, 16, 35, 36, 404/72, 12; 52/660, 663, 664; 428/99, 101, 103, 137; 116/63 R, 63 P

[56] References Cited

U.S. PATENT DOCUMENTS

| | | | |
|---|---|---|---|
| 118,952 | 9/1871 | Lewis | 52/663 |
| D. 172,324 | 5/1954 | Wiswell . | |
| 1,698,594 | 1/1929 | Hoff . | |
| 2,021,759 | 11/1935 | White . | |
| 2,067,698 | 1/1937 | Hall | 404/16 |
| 2,153,392 | 4/1939 | Robertson | 404/16 |
| 2,163,346 | 6/1939 | Morrison . | |
| 2,269,522 | 1/1942 | Dreibuss et al. | 52/660 |
| 2,327,640 | 8/1943 | Hendry | 404/36 |
| 2,371,462 | 3/1945 | Nicholson . | |
| 2,405,556 | 8/1946 | Bogle | 404/36 |
| 2,574,090 | 11/1951 | Dofsen | 404/15 |
| 3,334,554 | 8/1967 | Adams | 116/63 P |
| 3,752,396 | 8/1943 | Bustin | 52/660 X |
| 3,820,912 | 6/1974 | Hughes | 404/35 |
| 3,880,537 | 4/1975 | Harris et al. . | |
| 4,080,228 | 3/1978 | Currigan . | |
| 4,135,339 | 1/1979 | Pawlitschek | 52/660 |
| 4,135,839 | 1/1979 | Engwall | 404/16 |

FOREIGN PATENT DOCUMENTS

| | | | |
|---|---|---|---|
| 679756 | 9/1952 | United Kingdom | 404/35 |
| 689791 | 4/1953 | United Kingdom | 404/16 |
| 2036140 | 6/1980 | United Kingdom | 404/15 |

OTHER PUBLICATIONS

The Goodyear Tire & Rubber Company Publication: Portable Speed Bumps, Dated Mar., 1980.

*Primary Examiner*—James A. Leppink
*Assistant Examiner*—Beverly E. Hjorth
*Attorney, Agent, or Firm*—Henderson & Sturm

[57] ABSTRACT

A portable apparatus for warning drivers of temporary and/or hazardous road conditions ahead comprising a portable flat mat of resilient material which is either removably or permanently secured to the road surface in or near the path of an oncoming vehicle, and which has a plurality of equidistantly sapced slotted openings formed therein each of a size to completely, momentarily receive at least one of the front tires of the vehicle. When the said front or any other tire runs over said slotted openings, an audible and mechanical rumbling of the vehicle is set up thereby warning and physically alerting the driver of a road condition ahead which requires special attention.

5 Claims, 8 Drawing Figures

PORTABLE HIGHWAY WARNING APPARATUS

BACKGROUND OF THE INVENTION

Known portable devices for warning drivers of temporary hazardous road conditions provide either a visual warning only, or if an attempted audible or mechanical warning device is provided it is of such a complicated and expensive structure that the cost tends to be prohibitive. Furthermore, such audible or mechanical road warning devices are subject to movement or "dancing" across the highway road surface during coaction with the vehicles and are therefore uncertain as to their placement retention on the road surface.

One example of a known warning device is that of a plurality of parallel, transversely extended mounds of bituminous or like material. This type of warning device has several disadvantages, however; one being the length of time of installation and or removal. Another is the permanent disfigurement of the road surface upon removal, requiring at times another process of repair in the nature of patching. Yet another is the fact that the bituminous material is then normally discarded.

SUMMARY OF THE INVENTION

The present invention relates to a portable apparatus for warning drivers of dangerous or hazardous road conditions ahead which comprises one or more elongated flat mats of resilient material, such as rubber or the like, each mat having a generally rectangular shape and having formed therein at least one set of transversely extended, equidistantly longitudinally spaced openings of identical size and shape. The width of each opening is such that when the mat is placed directly in front of a tire of a conventional highway vehicle, the tire, moving normal to the transverse extent of the openings or slots, sinks sequentially within the slots to set up an audible and mechnical rumbling of the vehicle to forewarn the driver. Each mat can be secured to the road by an adhesive, or by a plurality of anchor bolts inserted through the mat into the road, or by one or more resilient cable units threaded through the fore and aft portions of each mat and stretched across the road to be staked at each side of the road, or by any combination of these arrangements.

An advantage of the portable nature of the warning apparatus is that each mat can easily be removed when highway work is suspended, or when the temporary danger is removed, and again quickly replaced when necessary. Motorists are not lulled into an unconcerned attitude which often tends to result when warning signs and devices are left in place when not needed. For example, when motorists see signs and warnings of certain highway work and perils which they then fail to encounter as they proceed, this tends to erode their faith in such signs and warnings.

It is therefore an object of the present invention to provide an improved portable highway or road warning device.

It is another object of the present invention to provide a portable road warning device which effects both an audible and mechanical warning to a motorist as he or she drives over it.

Another object of this invention is to provide a portable road warning device which can be quickly removably secured in place on a road surface to forewarn oncoming motorists of road perils ahead.

Yet another object of this invention is to provide a portable road warning device having the aforementioned advantages which is economical to manufacture while being dependable and reliable in its use, having the capability of being used over and over again.

Other objects, advantages and novel features of the present invention will become apparent from the following detailed description of the invention when considered in conjunction with the accompanying drawings.

DESCRIPTION OF THE PREFERRED EMBODIMENTS

Figure 1:
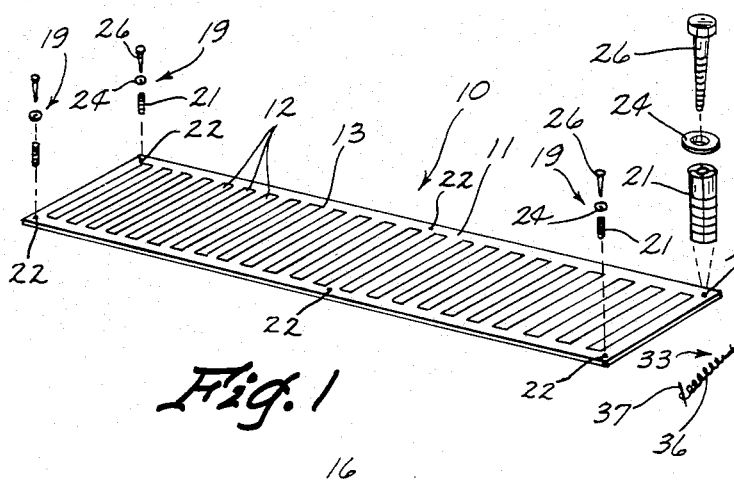
FIG. 1 is a perspective view of one embodiment of the invention, and showing road attaching units in exploded view.

A first embodiment of the invention is shown at 10 in FIG. 1, the portable warning or "rumble" apparatus comprising a substantially rectangular mat 11 of resilient material having a plurality of equidistantly spaced openings 12 formed therein, with the openings having their lengthwise dimension extended transverse to the width of the mat 11. The mat 11 has a solid periphery 13 about all four edges, and the openings 12, termed "slots" hereinafter, are uniform in shape and dimension and are formed parallel in a single row.

Figure 3:
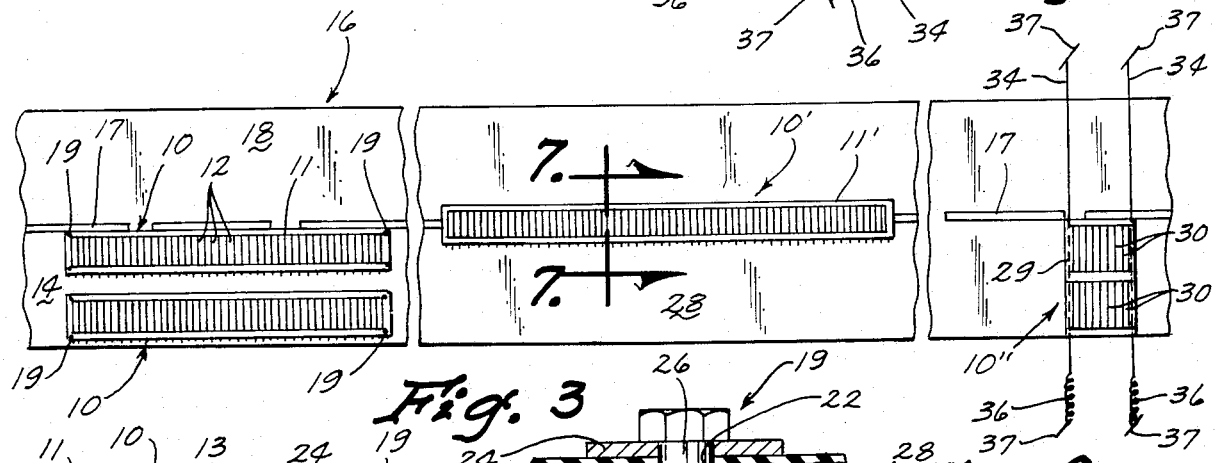
FIG. 3 is a plan view of a highway, broken into portions, with differing arrangements of the embodiments of the invention being illustrated.
Figure 4:
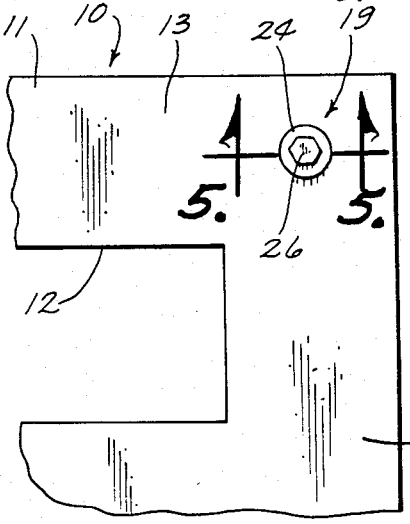
FIG. 4 is an enlarged fragmentary view of a corner of the embodiment of FIG. 1.

To ensure that an audible and mechnical rumbling of the vehicle results when one of its leading tires runs across the mat 11, the slots 12 each have a length of approximately forty (40) inches, with a width of approximately six (6) inches. It is noted the length and width of the slots 12 actually extend the width and length, respectively, of the mat 11. It has been ascertained that the tread width of an average, conventional over-the-road tractor-trailer tire striking the road surface is approximately 7–8½ inches, thus the length of the slots 12 is ample to completely receive the tire tread as the tire moves normal to the set of slots 12, as seen in FIG. 3 where a pair of mats 11 have been placed side-by-side. This assumes the mat 11 is placed directly in line with the direction and path of movement of one of the leading tires of the vehicle, the vehicle traveling in its normal position centered in its lane.

The mats 11 of FIG. 3 are placed such that each mat is located to receive the leading tire of a conventional vehicle moving from left to right on the lower half or lane 14 of the highway road 16, the center stripe 17 separating the two opposite lanes 14 and 18 of opposing traffic. It of course follows that should both leading tires move across the mats 11, the trailing tires would also, assuming the vehicle stayed in the lane 14.

Each mat 11 has an outer dimension of approximately 4'×23 ½', and a thickness of approximately ⅝". One mat actually used for experimental purposes by the inventors was a commercially available conveyor belting with the trade name Plylon manufactured and sold by Goodyear Tire & Rubber Company. It is believed that any resilient, possibly reinforced, material such as that would be of suitable composition and have suitable life for the intended purpose of the invention.

Figure 5:
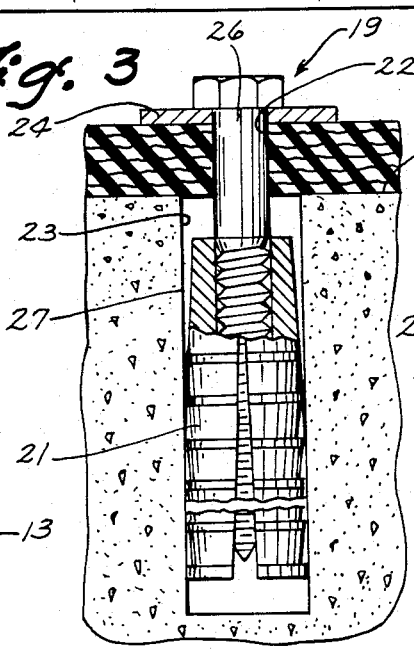
FIG. 5 is an enlarged vertical sectional view taken along the line 5—5 in FIG. 4.

Each mat 11 is removably secured in place, as shown for example in FIG. 3, by a plurality of anchor bolt units 19 shown in FIGS. 1 and 3. Each unit 19 comprises an expandable sleeve 21 which is insertable into a properly sized hole 23 drilled into the road 16 material (concrete or bituminous conventionally); a washer 24 placed over a hole 22 formed in the peripheral edge 13 of the mat 11 and an anchor bolt 26 inserted through the mat hole 22 and further insertable into the sleeve 21 so as to expand the sleeve 21 into locking engagement with the walls 27 (FIG. 5) of the road material hole 23. Referring to FIG. 1, it will be noted mat holes 22 are formed in the corners and in the sides of the mat 11.

A modified mat apparatus 10' is shown in the center fragmented portion of FIG. 3, laid right down the centerline stripe 17 of the highway. Mat 11' is substantially identical to mat 11 except it is longer and can have holes 22 formed therein, or it may be held to the surface 28 (FIG. 7) of the road by an adhesive 25 of commercial availability for bonding rubber or the like to surfaces such as concrete or bituminous. A peel-off type backing (not shown) can be provided which would be removed only when the mat 11' was put into use. It should be realized that this arrangement provides for only one use of a mat 11'; however, in certain highway locations a more permanent centerline mat 11' may be preferable as a means of warning a motorist that he or she is riding on or moving across the center stripe 17. This arrangement thus warns a motorist against "drifting" out of his or her lane.

A second modification is the apparatus 10", shown particularly in FIGS. 2, 3, 6 and 8. The mat 29 has a width substantially the same as the entire width of the lane 14, is again generally rectangular with a solid peripheral edge 13 as with the mat 11, and rather than one row of equidistantly spaced, uniform openings or slots 30 formed parallel therein, has a pair of rows 31 and 32 of slots 12. The rows 31 and 32 are spaced laterally apart such that their longitudinal centerlines are located approximately in the path of the leading, front tires of an oncoming conventional highway vehicle. The length of each slot 30 may be slightly greater than that of the slots 12, as illustrated, however the criteria that the length again is sufficient to fully receive the full tread width of said vehicle, from a small car to the large over-the-highway tractor trailer-type truck, is followed.

Figure 2:
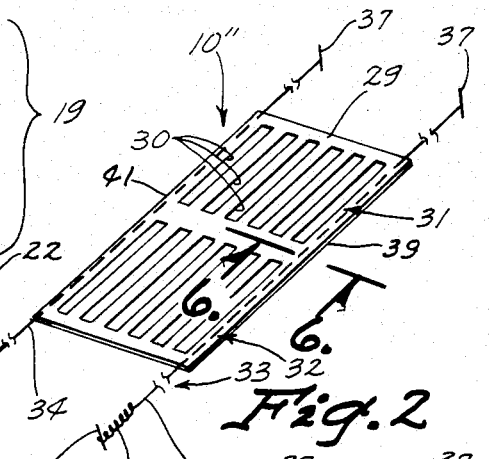
FIG. 2 is a perspective view of a second embodiment of the invention.
Figure 6:
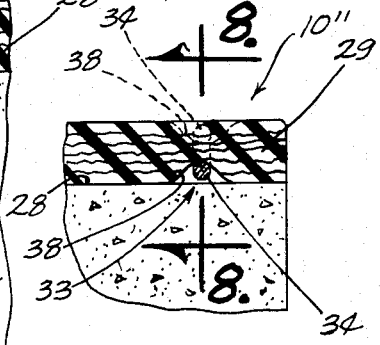
FIG. 6 is another vertical sectional view taken along the line 6—6 in FIG. 2.
Figure 8:
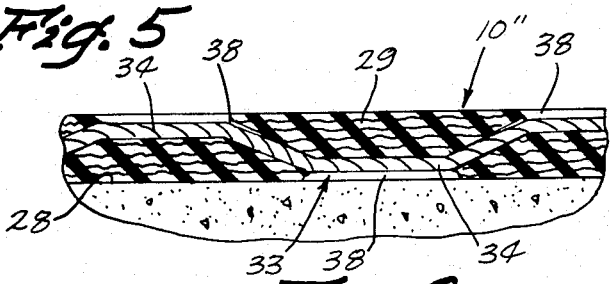
FIG. 8 is a vertical sectional view taken along the line 8—8 in FIG. 6.

The mat 29 is secured to the road surface by a pair of identical cable units 33 (FIGS. 2, 6 and 8). Each cable unit 33 comprises a cable 34 of a length to stretch completely across the highway 16, a coil spring 36 for connection at one end of the cable 34, and a pair of stakes 37 for securing the cable end and cable-spring end to the roadbed on each side of the highway 16.

To eliminate wear on each cable as much as possible, a flattened serpentine passage 38 is formed within and along the leading and trailing edges 39 and 41, respectively, of the mat 29. The depth of the open, upper and lower exposed portions (FIGS. 6 and 8) is such that under normal use, the cable exposed thereat will not be engaged with either a tire or the road surface 28. The cable 34 may be vulcanized in the mat 29 to prevent bunching up of the mat on the cable.

In actual tests, the embodiment 10" (FIG. 2) was held securely in place on a major highway for twenty-seven (27) straight days of use before one or more anchor bolt units, known otherwise as lag screws, worked loose. In another test, a quick drying epoxy was used in the anchor bolt holes 23, and at the end of twenty-five (25) days there was no evidence of loosening of the anchor bolts 26. The mat 11 can be quickly removed by withdrawing the anchor bolts 26 and washers 24, then inserting a shorter bolt (not shown) into the sleeve 21 to protect the hole 3 and sleeve 21 from filling with debris. Re-installation of the mat 11 can then be easily and quickly accomplished.

It is contemplated that a mat, such as 29, can be used in an emergency by merely being located in the path of oncoming vehicles as is shown in FIG. 3, without any initial securement to the highway. However, actual testing has shown that the mat tends occasionally to "dance" on the highway and to change its position when run over by one or more vehicles.

For that reason, securement of at least a temporary nature is recommended. The provision of the springs 36 at one end, or at both ends of the cables 34 near the stakes facilitates a retention of the mat 29 in its original position with the slots 30 transverse to the flow of traffic. When the mat 29 is no longer necessary, it is readily removed by withdrawing the stakes 37 and pulling the mat off the highway without significant inconvenience to traffic.

Another embodiment (not shown) is the provision of a single, elongated strip of belting material of the type referred to hereinbefore in connection with the mats 11 of the various embodiments illustrated. The strip could have, for example, the dimensions of a slot 12 of FIG. 1, and the thickness of the mat 11; or for example, it could extend completely across a lane, having a length of twelve (12) feet.

Figure 7:
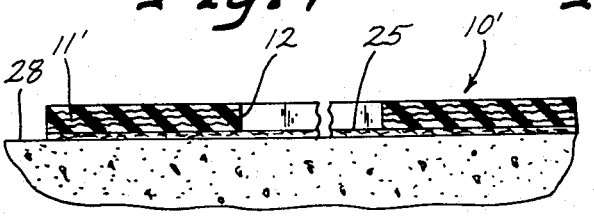
FIG. 7 is a slightly reduced, broken vertical sectional view taken along the line 7—7 in FIG. 3.

It could have a peel-off type backing to expose an adhesive material on the undersurface in the nature of the mat 11' and adhesive 25 of FIG. 7 and would be adhered to the highway as a permanent warning strip, placed transversely in single strip form or as a plurality of strips in the same manner as the slots 12 of FIG. 1. It is believed that this type of strip for audible and physical warning to the vehicle driver would outlast the contemporary bituminous material presently being used.

Obviously, many other modifications and variations of the present invention are possible in light of the above teachings, for example all types of securement can be applied to all embodiments of the mats. It is therefore to be understood, that within the scope of the appended claims, this invention may be practiced otherwise than as specifically described.

We claim:

1. A portable warning device in combination with a road having surface material thereon and multi-wheeled vehicles, wherein the portable warning device serves as an auxiliary surface, and is adapted for removeable securement to said surface material that serves as a primary surface to forewarn a driver of a multi-wheeled vehicle of a temporary or hazardous road condition ahead, wherein said portable warning device comprises a substantially rectangular integral mat of resilient material having an upper surface spaced above and parallel to a lower road contact surface, said mat having a plurality of substantially rectangular equidistantly spaced depressions formed in said upper surface of substantially equal size, each depression having its longest dimension extended transverse and normal, both to the lengthwise dimension of said mat as it is laid on a road surface, and to the direction of travel of at least some of the wheels of said multi-wheeled vehicle, said depressions forming a series of solid rectangular-type slats therebetween and with the entire lower surface thereof in contact with the road surface material and with the upper surface of said slats lying in the same plane as each other and as said mat's upper surface, and being parallel to the road surface;

said mat having a solid integral periphery, and said depressions being uniform and parallel each other and said slats; and means removeably affixing said mat to the surface material of the road, the lengthwise dimension of said mat being located as to extend parallel to the centerline of the road; wherein at least some of the wheels of said multi-wheeled vehicle will traverse the said depressions perpendicular to their longest dimension, so as to generate both an audible and vibrational warning to the driver of said multi-wheeled vehicle.

2. A device according to claim 1 wherein said depressions are openings such that said mat is devoid of material within said openings between said upper and lower surfaces.

3. A device according to claim 1 wherein said affixing means is an adhesive material.

4. A device according to claim 1 wherein said affixing means comprises an expandable sleeve insertable into the roadbed, and an anchor bolt removably insertable into said sleeve through an opening formed therefor in said mat.

5. A device according to claim 1 wherein said affixing means comprises one or more cable units secured to and stretched across the leading and/or trailing edges of said mat and staked into the ground on opposite sides of the road, each cable unit comprising a cable threaded through transversely formed openings formed therefor in said mat, a spring at one end of the cable for giving resiliency to said cable, and a pair of stakes.

* * * * *